US005691502A

United States Patent [19]

Craddock et al.

[11] Patent Number: 5,691,502

[45] Date of Patent: *Nov. 25, 1997

[54] LOW VELOCITY RADIAL DEPLOYMENT WITH PREDETERMINDED PATTERN

[75] Inventors: Gerald Graves Craddock, Arlington; Elmer C. Cruise, Grapeland, both of Tex.

[73] Assignee: Lockheed Martin Vought Systems Corp., Grand Prairie, Tex.

[ * ] Notice: The term of this patent shall not extend beyond the expiration date of Pat. No. 5,535,679.

[21] Appl. No.: 464,358

[22] Filed: Jun. 5, 1995

[51] Int. Cl.[6] ..... F42B 12/32

[52] U.S. Cl. ..... 102/494; 102/389; 102/489; 102/491; 102/499

[58] Field of Search ..... 102/389, 393, 102/473, 489, 491–497, 499, 500, 701

[56] References Cited

U.S. PATENT DOCUMENTS

| | | | |
|---|---|---|---|
| 1,154,437 | 9/1915 | Rimailho | 102/496 |
| 1,300,333 | 4/1919 | Berry | 102/389 |
| 3,263,612 | 8/1966 | Throner, Jr. | 102/67 |
| 3,474,731 | 10/1969 | Thomanek | 102/52 |
| 3,498,224 | 3/1970 | Cordle et al. | 102/67 |
| 3,667,390 | 6/1972 | Medin et al. | 102/67 |
| 3,967,553 | 7/1976 | Keraus et al. | 102/66 |

(List continued on next page.)

FOREIGN PATENT DOCUMENTS

| | | | |
|---|---|---|---|
| 0338874 | 10/1989 | European Pat. Off. . | |
| 1461522 | 2/1967 | France . | |
| 2220058 | 9/1974 | France . | |
| 2287671 | 5/1976 | France . | |
| 322640 | 1/1922 | Germany | 102/497 |
| 2262416 | 12/1972 | Germany . | |
| 1150914 | 5/1969 | United Kingdom . | |

OTHER PUBLICATIONS

Allen J. Tulis and James L. Austing, "Further Studies on the Detonation Characteristics of Very Low Density Explosive Systems", pp. 183–191, presented at the Proceedings Sixth Symposium (International) on Detonation, Aug. 24–27, 1976, Coronado, California.

Allen J. Tulis, "Techniques in the Formulation and Handling of Composite and Very–Low–Density Explosives", pp. 480–489, presented at the Internationale Jahrestagung, Jul. 1–3, 1981, Karlsruhe, Germany.

*Primary Examiner*—Harold J. Tudor

*Attorney, Agent, or Firm*—Sidley & Austin

[57] ABSTRACT

A plurality of objects is deployed in generally radial directions at low velocities in order to achieve a predetermined pattern of the deployed objects. The device has a metal inner wall member (20, 120) having a plurality of annular cylindrical segments of differing outside diameters, an explosive body (22, 122) of low velocity explosive, and a plurality of arrays (40, 140) positioned coaxially with and exteriorly of the explosive body (22, 122) and spaced along the length of the explosive body (22, 122). Each array (40, 140) comprises a plurality of objects (28). The explosive body (22, 122) can be in the form of a plurality of annular sections which provide the objects (28) in each array with an amount of energy different from that provided to each of the objects in the adjacent array. An annular flange (32) can separate the forward end of the explosive body (22, 122) from a booster ring (66), or the booster ring (166) can be positioned within a central cavity of the inner wall member (120). A plurality of holes (168) in the inner wall member (120) can expose the explosive body (122) to the detonation of the booster ring (166). The holes (168) can be aligned with the objects (28) in the radially adjacent array and/or aligned with points between adjacent objects. Outwardly extending flanges (32, 34 or 132, 134) can serve as reflection surfaces for explosive pressure waves. One or more safe arm fuzes (90, 92, 190) can be encased in foam (94, 194) and positioned within an annular structure (76, 120). An annular explosive section can be in the form of discrete segments spaced apart about the circumference of the explosive body.

29 Claims, 4 Drawing Sheets

U.S. PATENT DOCUMENTS

| | | | |
|---|---|---|---|
| 3,974,771 | 8/1976 | Thomanek | 102/67 |
| 3,977,327 | 8/1976 | Brumfield et al. | 102/67 |
| 4,026,213 | 5/1977 | Kempton | 102/56 SC |
| 4,145,972 | 3/1979 | Meng | 102/701 |
| 4,303,015 | 12/1981 | Bourlet | 102/492 |
| 4,351,240 | 9/1982 | McCubbin et al. | 102/364 |
| 4,430,941 | 2/1984 | Raech, Jr. et al. | 102/496 |
| 4,648,323 | 3/1987 | Lawther | 102/495 |
| 4,768,440 | 9/1988 | Deneuville et al. | 102/495 |
| 4,848,239 | 7/1989 | Wilhelm | 102/492 |
| 5,038,686 | 8/1991 | Zulkoski et al. | 102/496 |
| 5,064,462 | 11/1991 | Mullendore et al. | 75/248 |
| 5,361,700 | 11/1994 | Carbone | 102/439 |

LOW VELOCITY RADIAL DEPLOYMENT WITH PREDETERMINDED PATTERN

GOVERNMENT LICENSE RIGHTS

The U.S. Government has a paid-up license in this invention and the right in limited circumstances to require the patent owner to license others on reasonable terms as provided for by Contract DASG60-83-C-0108, awarded by the Department of the Army.

FIELD OF THE INVENTION

This invention relates to a device for deploying a plurality of precisely shaped objects at low velocities to provide a desired dispersed pattern of the objects. The invention can be employed in an interceptor missile for the purpose of increasing the area of potential impact with a target.

BACKGROUND OF THE INVENTION

Two basic approaches to endoatmospheric non-nuclear destruction of an incoming missile or aircraft are 1) hit-to-kill by directly impacting the target with a large, heavy interceptor mass at high velocity, and 2) blast-fragmentation involving multiple impacts of small fragments at very high velocities and strike angles (from the interceptor's nose) resulting from the explosion of a high explosive warhead in the interceptor in the vicinity of the ballistic missile.

The hit-to-kill or kinetic energy technology approach is based on the fact that when one object strikes another object at high speeds, a tremendous amount of destructive energy is released. The impact of an interceptor missile with an incoming tactical ballistic missile, aircraft, or cruise missile, can result in the total disintegration of both vehicles. Such impact can literally vaporize even metals. In contrast, blast-fragmentation warheads may only redirect or break up the target vehicle. However, even with a large hit-to-kill interceptor, the effective impact window is relatively small.

Cordle et al, U.S. Pat. No. 3,498,224, discloses a fragmentation warhead comprising a solid high explosive charge surrounded by a series of five axially spaced steps, with each of four of the steps containing a different number of circumferential layers of steel cubes to yield a fragment beam pattern made up of fragments having varying velocities. As illustrated in FIG. 5 of Cordle et al, each of the deployment velocities is substantially greater than the missile velocity $V_M$. The five steps could be considered to be five separate warheads joined in tandem, with each warhead section employing a different uniform charge-to-metal ratio. The fragmentation pattern presented to an area some uniform distance away (large in proportion to the size of the warhead) is said to be extremely dense and in a relatively narrow beam on the order of 10° wide. The fragments are identified as 3/16 inch steel cubes, with the weight of each of the fragments being 13 grains.

Thomanek, U.S. Pat. No. 3,474,731, describes a fragmentation warhead for use against personnel in an armored target. The warhead has a fragmentation casing arranged to separate into a multiplicity of elements upon detonation of the high explosive charge. The elements, which can be embedded in a synthetic resin, can be spherical, disk-shaped, or irregularly shaped. The fragmentation casing can be configured to direct the fragmentation elements in a number of specific directions.

Kempton, U.S. Pat. No. 4,026,213, discloses an aimable warhead having a thin metal outer skin and a stronger inner metal casing. The high explosive is contained in the annular space between the two shells, and is in contact with a plurality of circumferentially spaced initiators. A selected initiator can be fired to rupture an arcuate section of the outer skin while not causing a detonation of the main charge, and then another initiator can be fired to detonate the main charge, thereby fragmenting the thicker inner casing and driving the fragments through the ruptured arcuate section.

Throner, Jr., U.S. Pat. No. 3,263,612, describes a fragmentation weapon wherein the fragments in a first group of fragments are large in size and the fragments in a second group of fragments are smaller in size. The fragments can be positioned about a charge of high explosive and initially bonded together by a matrix of plastic resin and then covered with a sheath formed from fiberglass impregnated with plastic resin. Each of the larger fragments can have a mass of about 140 grains while each of the smaller fragments can have a mass of about 30 grains. Although the shape of the fragments is stated to not be critical, cubes are preferred.

Raech, Jr. et al, U.S. Pat. No. 4,430,941, describes a projectile in which packs of flechettes are supported by a frangible matrix of small smooth glass microspheres bound together and to the flechettes by resin. The matrix prevents the flechettes from being damaged during acceleration of the projectile.

Bourlet, U.S. Pat. No. 4,303,015, describes a pre-fragmented explosive shell wherein a plurality of balls is housed in an annulus about a high explosive charge. The balls can have a tungsten or tungsten carbide core with a zirconium coating.

While the foregoing patents disclose warheads producing fragment patterns utilizing discrete small pre-formed fragments, none discloses the use of a "slow" or low explosive propellant to radially deploy a plurality of precisely shaped high mass objects at low velocities to provide a desired dispersed pattern of the objects, whereby the effective hit-to-kill window is enhanced.

Copending patent application Ser. No. 08/360,977, filed on Dec. 20, 1994, by Gerald G. Craddock, now U.S. Pat. No. 5,535,679, discloses a device for deploying a plurality of objects in generally radial directions at a low velocity in order to achieve a predetermined pattern of the deployed objects, said device comprising: an inner wall member; an annular body of low velocity explosive positioned exteriorly of and coaxially with the inner wall member; a plurality of annular arrays positioned coaxially with and exteriorly of the annular body of low velocity explosive, each annular array comprising a plurality of objects, the annular arrays being positioned at different locations along the central longitudinal axis of the annular body of low velocity explosive such that the energy provided each of the objects in a first annular array by the amount of the low velocity explosive in radial alignment with the first annular array is different from the energy provided each of the objects in a second annular array by the amount of the low velocity explosive in radial alignment with the second annular array. Each of the objects can have a shape which minimizes aerodynamically induced deviations in the path of the object during the deployment of the object, a mass of at least 50 grams, and a density of at least 15 gm/cc. The objects can be positioned in a matrix of a synthetic polymeric material containing hollow glass microspheres. The low velocity explosive has a detonation velocity of less than 5000 meters per second and more preferably less than 4000 meters per second. The resulting radial deployment velocity of the objects is preferably less than about 600 feet per second and more preferably less than about 500 feet per second.

Thus, in accordance with the Craddock invention, the hit-to-kill effect can be enhanced by a small, lightweight, agile interceptor that does not pre-empt a direct hit, and which incorporates a small number of fragments of high mass density which are deployable in a desired pattern with low deployment velocities and low strike angles, thereby substantially increasing the effective impact window. However, it is desirable that improvements be made in the Craddock device.

SUMMARY OF THE INVENTION

The present invention provides several improvements to the Craddock device.

In a first aspect of the present invention, the inner wall member is formed as a plurality of annular wall sections spaced along the central longitudinal axis, with each of the annular wall sections having a substantially cylindrical outer surface, and with adjacent annular wall sections having differing outer diameters. Similarly, the annular body of low velocity explosive comprises a plurality of annular explosive sections, with each of the annular explosive sections being positioned coaxially with and exteriorly of the substantially cylindrical outer surface of a respective one of the annular wall sections. Each of the annular arrays is positioned coaxially with and exteriorly of a respective one of the annular explosive sections. Each of the annular explosive sections can have a different radial thickness such that each of the annular explosive sections has an amount of low velocity explosive which is different from the amounts of low velocity explosive in the other annular explosive sections. Thus, the energy provided to the objects in a first one of the plurality of annular arrays by the annular explosive section radially adjacent thereto can be different from the energy provided to the objects in a second one of the plurality of annular arrays by the annular explosive section radially adjacent thereto.

In one embodiment of the first aspect of the invention, the first annular explosive section provides each of the objects in the radially adjacent array with greater energy than is provided to objects in the array radially adjacent to the second annular explosive section. In another embodiment of the first aspect of the invention, the second annular explosive section provides each of the objects in the radially adjacent array with greater energy than is provided to objects in the array radially adjacent to the first annular explosive section. In either embodiment, a third annular explosive section can provide its adjacent objects with less energy than is provided to either of the first two arrays. This enables the selection of the array which will provide the objects for the outermost circle of deployed objects.

In a second aspect of the invention, the inner wall member has an annular flange extending radially outwardly therefrom. The forwardmost annular explosive section is positioned against the rearwardly facing surface of the flange while a booster ring is positioned against the forwardly facing surface of the flange. The annular flange has a plurality of holes therethrough to expose the forwardmost annular explosive section to detonation of the booster ring. The booster ring is at least substantially enclosed by the flange, a portion of the inner wall member extending longitudinally forwardly of the flange, and an annular fitting member.

In a third aspect of the invention, an outwardly extending annular flange can be provided at the front end of the annular body of explosive and an outwardly extending annular member can be provided at the rear end of the annular body of explosive to act as reflective surfaces for explosive pressure waves in the annular body of low velocity explosive.

In a fourth aspect of the invention, a booster ring is positioned radially inwardly of the forwardmost one of the plurality of annular wall member sections, and the forwardmost annular wall section is provided with a plurality of holes extending at least generally radially therethrough so that the booster ring initially fires the forwardmost annular explosive section. In one embodiment of the fourth aspect of the invention, the plurality of holes includes a first group of holes and a second group of holes at spaced locations about the circumference of the forwardmost annular wall section. Each of the first group of holes is positioned in radial alignment with a respective one of the objects of the forwardmost annular array, while each of the second group of holes is positioned in radial alignment with an intermediate point between a respective pair of the objects of the forwardmost annular array. Each pair of objects having one of the second group of holes therebetween can be positioned between two of the first group of holes. This arrangement provides for greater energy levels to be imparted to the objects in radial alignment with a hole than is imparted to the other objects in the forwardmost array.

In another embodiment of the fourth aspect of the invention, each of the holes in the forwardmost annular wall section is positioned so as to be in radial alignment with a respective one of the objects of the forwardmost first annular array.

In another embodiment of the fourth aspect of the invention, each of the holes in the forwardmost annular wall section is positioned so as not to be in radial alignment with any of the objects of the forwardmost first annular array. In particular, each hole can be equally spaced from adjacent objects.

In a fifth aspect of the invention, the safe arm fuze for the booster ring is positioned radially inwardly of the annular wall member, thereby reducing the required length of the device. A second safe arm fuze can also be provided. If desired, the two safe arm fuzes can be encased in shock attenuating foam.

In a sixth aspect of the invention, the inner wall member is formed of a metal, e.g., aluminum, in order to provide greater strength.

In a seventh aspect of the invention, at least one of the plurality of annular explosive sections can be in the form of a plurality of individual annular segments spaced apart from each other about the circumference of the annular explosive section. This configuration permits a savings in the amount of low explosive material when the objects in the radially adjacent array are spaced apart a significant distance.

DETAILED DESCRIPTION

Figure 1:
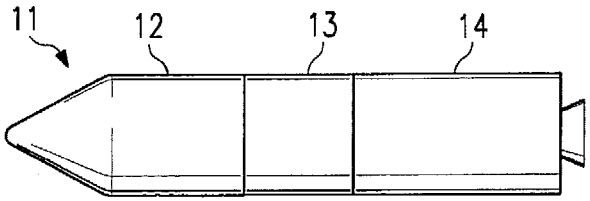
FIG. 1 is a side view of a missile.

Referring now to FIG. 1, the interceptor missile 11 comprises a guidance section 12, a warhead section 13, and a rocket propulsion section 14 joined together along the longitudinal axis 15 (FIG. 2) of the missile 11. The guidance section 12 contains suitable guidance components, e.g., a guidance sensor, an inertial measurement unit, a guidance processor, and a guidance control unit for effecting guidance control of the missile 11, e.g., by positioning of aerodynamic fins or by firing attitude control rocket thrusters. The interceptor missile can be ground-launched and inertially guided by aerodynamic fins toward a predicted intercept point. In the final flight phase, the on-board guidance sensor, which can be an active radar seeker, acquires the target and provides instantaneous data to the on-board guidance processor. The guidance processor can calculate an updated predicted intercept point with the target, and can provide homing guidance signals to control the firing of small solid rocket thrusters mounted near the nose of the interceptor missile 11. The warhead section 13 is a lethality enhancing device for radially deploying a plurality of objects at a low velocity in order to achieve a predetermined pattern of the deployed objects. The propulsion section 14 can be any suitable rocket motor. The relatively small size of the interceptor missile 11 enables the missile 11 to respond rapidly to guidance commands.

Figure 2:
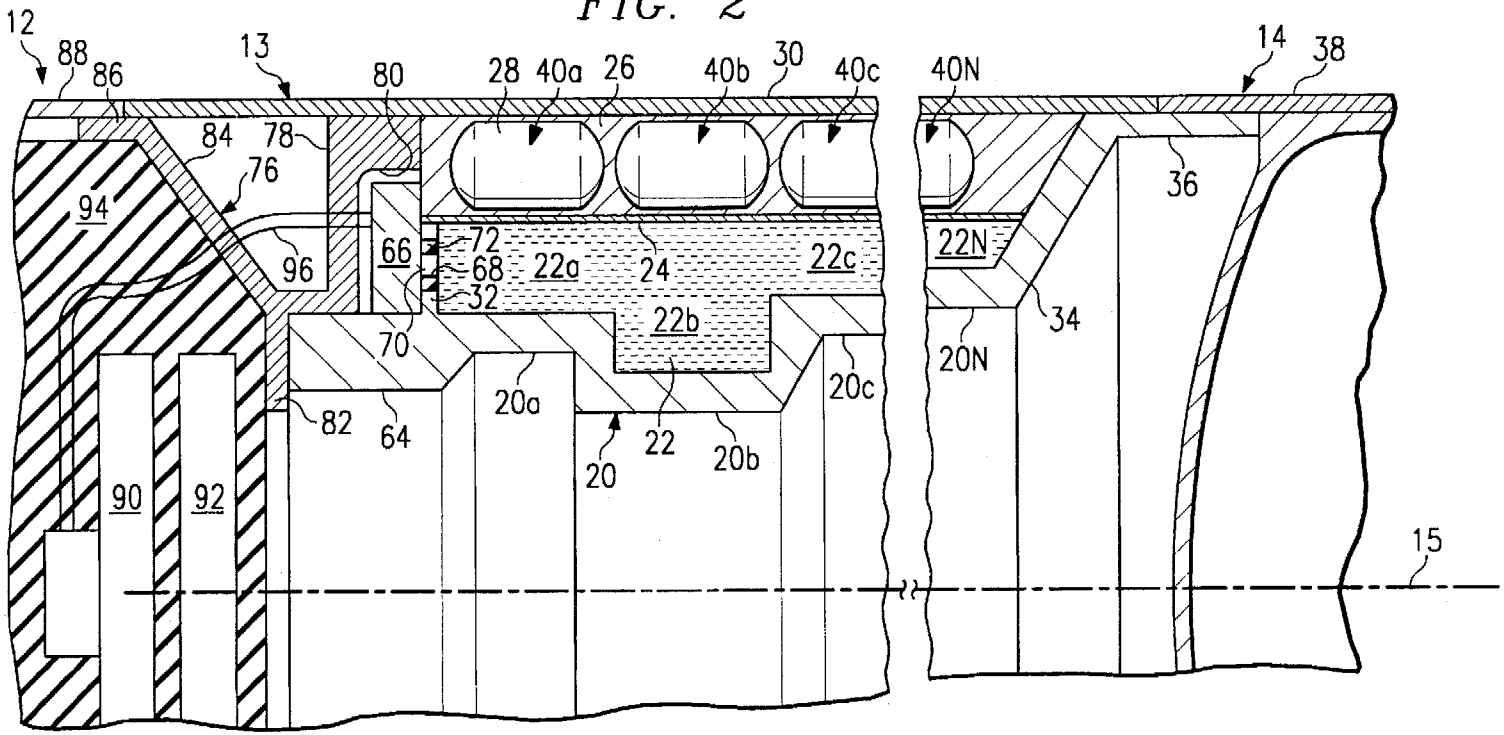
FIG. 2 is a cross-sectional view along a portion of the longitudinal axis of the missile of FIG. 1 illustrating a first embodiment of the present invention.

Referring now to FIG. 2, the lethality enhancing device 13 has an inner annular wall member 20, an annular body 22 of a low velocity explosive, an annular liner wall 24, an annular matrix 26 containing a plurality of arrays of discrete objects 28, and an annular external shell 30. Each of the inner annular wall member 20, the annular body 22, the annular liner wall 24, the annular matrix 26, and the annular external shell 30 has a central longitudinal axis which extends along the central longitudinal axis 15 of the missile 11.

The inner annular wall member 20 comprises a plurality of annular wall sections 20*a*, 20*b*, 20*c*, . . . 20N which are spaced along the central longitudinal axis 15, with the value of N being any desired whole number greater than three. Each of the annular wall sections 20*a*–20N has a substantially cylindrical outer surface, and adjacent annular wall sections have differing outer diameters, thus forming a stepped exterior surface for the inner annular wall member 20. In the illustrated embodiment, the outer diameter of the first annular wall section 20*a* is greater than the outer diameter of the adjacent second annular wall section 20*b*, but is less than the outer diameter of the third annular wall section 20*c*, which in turn is less than the outer diameter of annular wall section 20N. The inner annular wall member 20 is advantageously formed of a suitable metal, e.g., aluminum.

The annular wall member 20 has an annular flange 32 which extends radially outwardly from the front edge of the forwardmost annular wall section 20*a*, and an annular flange 34 which extends outwardly from the rear edge of the rearmost annular wall section 20N. While annular flange 34 can extend radially outwardly, in the illustrated embodiment, it extends outwardly and rearwardly at an acute angle of approximately 45°. The annular flanges 32 and 34 provide reflective surfaces for explosive pressure waves in the annular body 22 of low velocity explosive. The inner wall 20 also includes an annular flange 36 which extends longitudinally rearwardly from the outer edge of flange 34. The external diameter of the flange 36 is slightly less than the internal diameter of the annular external shell 30 and the internal diameter of the shell flange 38 of the propulsion section 14, such that flange 36 provides a mounting shoulder for receiving the forwardly extending annular flange 38 of the propulsion section 14, whereby the propulsion section 14 and the lethality enhancing device 13 can be joined together by suitable means, e.g., radially extending screws (not shown) extending through the annular flange 38 or the shell 30 into the axially extending flange 36.

The annular liner wall 24, which is of cylindrical configuration, is positioned exteriorly of and spaced from the inner annular wall member 20. The annular body 22 of a low velocity explosive is positioned exteriorly of the inner annular wall member 20 and interiorly of the annular liner wall 24. The annular body 22 of low velocity explosive has a stepped internal configuration so as to mate with the stepped external configuration of the inner wall member 20, and a generally cylindrical external configuration so as to mate with the cylindrical inner configuration of annular liner wall 24. Accordingly, the annular body 22 fills the annular space defined by the exterior surface of the stepped portions 20*a*–20N of the annular inner wall member 20, the inner surface of the annular liner wall 24, the rearwardly facing surface of the annular flange 32 and a portion of the forward surface of the flange 34. Thus, in the illustrated embodiment, the annular body 22 of low velocity explosive comprises a plurality of annular explosive sections 22*a*, 22*b*, 22*c*, . . . 22N, with each of the annular explosive sections being positioned coaxially with and radially exteriorly of the substantially cylindrical outer surface of a respective one of the annular wall sections 20*a*, 20*b*, 20*c*, . . . 20N. Thus, the radial thickness of the low velocity explosive body 22 varies along the longitudinal length of the inner wall member 20 as each of the annular explosive sections 22*a*, 22*b*, 22*c*, . . . 22N has a different radial thickness. Where each annular explosive section is an uninterrupted ring, the different radial thicknesses of the annular explosive sections permit each of the annular explosive sections to have an amount of the low velocity explosive which is different from the amounts of the low velocity explosive in the other annular explosive sections.

The lethality enhancing objects 28 are embedded in the annular matrix 26, which is formed of frangible material in order to maintain the lethality enhancing objects 28 in the desired relative positions while in the undeployed state in the lethality enhancing device 13 but which is readily broken up so as to release the lethality enhancing objects 28 upon detonation of the low velocity explosive body 22. The annular matrix 26 and the discrete objects 28 fill the space between the outer surface of the annular liner wall 24 and the radially adjacent inner surface of the annular external shell 30. The discrete objects 28 are arranged in a plurality of arrays 40*a*, 40*b*, 40*c*, . . . 40N which are positioned coaxially with and exteriorly of the annular body 22 of explosive at different locations along the central longitudinal axis of the missile 11, with each annular array having a circular configuration in a plane perpendicular to the longitudinal axis 15 of the missile and containing a plurality of lethality enhancing objects 28 spaced apart about the circumferential extent of the respective array. The matrix 26 is preferably a synthetic polymeric material containing hollow glass microspheres. The hollow glass microspheres substantially reduce the weight of the matrix 26 without a prohibitive sacrifice in the structural strength of the matrix 26. The hollow glass microspheres give shock mitigation, i.e., act as shock absorbers, and reduce the surface contact of the objects 28 with the polymeric material of the matrix 26, thereby facilitating separation of the objects 28 from the matrix 26. The presence of the resin matrix between the objects 28 and the low velocity explosive material 22 provides for a slower velocity of the objects 28 when deployed. The ratio of glass microspheres to resin in the matrix 26 can be varied to obtain the desired properties, such as structural integrity prior to the detonation of the low velocity explosive body 22. If desired, the hollow microspheres can contain a reactive material, such as an incendiary material or an exothermic material, e.g., thermite. Such incendiary material or exothermic material can still be included in the matrix 26 even when the microspheres are omitted. The matrix 26 itself can be formed from a reactant material, e.g., polytetrafluoroethylene. If desired, the matrix 26 can be in the form of an aluminum alloy cast about the objects 28. The aluminum alloy matrix is particularly advantageous where desired flexibility includes the option of the interceptor missile 11 being maintained intact until it impacts the target.

Each annular array 40*a*–40N can be embedded in a single matrix 26 to position all of the annular arrays of lethality enhancing objects 28, or each annular array 40*a*–40N can be in a respective discrete annular section of frangible matrix material. The number of annular arrays and the number of lethality enhancing objects 28 within each annular array can be varied in accordance with the size of the desired pattern of deployed lethality enhancing objects 28 and the spacing of the deployed objects 28 within the desired pattern. In the illustrated embodiment, the number of annular arrays 40*a*–40N corresponds to the number of inner wall sections 20*a*–20N and the number of annular explosive sections 22*a*–22N, with each of the annular explosive sections 22*a*–22N being positioned in contact with and radially outwardly from a respective one of the annular wall sections 20*a*–20N, and each of the annular arrays 40*a*–40N being positioned coaxially with, adjacent to and radially outwardly from a respective one of the annular explosive sections 22*a*–22N. The number of lethality enhancing objects 28 in each array 40*a*–40N can be the same or different. The lethality enhancing objects 28 in each undeployed annular array can be spaced apart at equal intervals about the circumferential extent of the respective array, or the lethality enhancing objects 28 in a particular annular array can be spaced apart at differing intervals. The objects 28 in a particular array are preferably spaced at equal centerline-to-centerline intervals.

While it is possible for the positions of the lethality enhancing objects 28 in one of the annular arrays 40*a*–40N to correspond to the positions of selected ones of the lethality enhancing objects 28 in another one of the annular arrays 40*a*–40N, e.g., the positions of the lethality enhancing objects 28 in the third annular array 40*c* can correspond to the positions of every other one of the lethality enhancing objects 28 in the first annular array 40*a*, the angular intervals in each annular array can be offset from the angular intervals in the adjacent annular arrays in order to provide a more uniform spacing of the objects when deployed. If desired, the ends of the objects 28 in one annular array can fit between the ends of the objects 28 in an adjacent annular array in order to reduce the total axial length required by the annular arrays 40*a*–40N. In general, the lethality enhancing objects 28 in a particular ring or array will be deployed in a circular pattern, with the lethality enhancing objects 28 of the array having the fastest deployment velocity forming a large diameter circular pattern, while the lethality enhancing objects 28 of the array having the slowest deployment velocity form a small diameter circular pattern, thereby forming a composite pattern of concentric circular arrays of deployed lethality enhancing objects 28.

The wall member 20 can provide structure support for the lethality enhancing device 13 as well as a reactive mass against which the surrounding layer 22 of low velocity explosive reacts to drive the lethality enhancing objects 28 generally radially outwardly. The radial thickness of each of the annular wall sections 20*a*, 20*b*, 20*c*, . . . 20N can be at least substantially the same, or these radial thicknesses can differ from each other, thus providing different tamper mass for the different annular explosive sections 22*a*–22N. The annular arrays 40*a*–40N are positioned at different locations along the central longitudinal axis of the annular body 22 of low velocity explosive such that the amount of energy provided to the plurality of objects 28 in one annular array is different from the amount of energy provided to the plurality of objects 28 in another annular array. For example, the radial deployment velocity of the objects 28 in the highest velocity array can be two to three times the radial deployment velocity of the objects 28 in the lowest velocity array. This variation in imparted energy can be achieved in any suitable manner.

In the embodiment illustrated in FIG. 2, the annular explosive sections 22*a*–22N have different radial thicknesses. Assuming a uniform concentration of the low velocity explosive in the annular body 22 of explosive, then the amount of the low velocity explosive in the annular explosive section 22*a* in radial alignment with the first annular array 40*a* is less than the amount of the low velocity explosive in the second annular explosive section 22*b* in radial alignment with the second annular array 40*b*, which in turn is greater than the amount of the low velocity explosive in the third annular explosive section 22*c* in radial alignment with the third annular array 40*c*, which in turn is greater than the amount of the low velocity explosive in the annular explosive section 22N in radial alignment with the rearmost annular array 40N. Thus, each of the annular explosive sections 22*a*–22N can have an amount of low velocity explosive which is different from the amounts of the low velocity explosive in the other annular explosive sections. Assuming an equal number of objects 28 in each of the arrays 40*a*–40N, the amount of energy provided to each of the plurality of objects 28 in the first annular array 40*a* by the amount of the low velocity explosive in the first annular explosive section 22*a* would be less than the amount of energy provided to each of the plurality of objects 28 in the second annular array 40*b* by the amount of the low velocity explosive in the second annular explosive section 22*b*, which in turn is greater than the amount of energy provided to each of the plurality of objects 28 in the third annular array 40*c* by the amount of the low velocity explosive in the third annular explosive section 22*c*. However, the variation in energy provided the lethality enhancing objects 28 individually can also be achieved by varying the mass of the lethality enhancing objects 28, varying the composition of the low velocity explosive body 22 adjacent the various annular arrays 40*a*–40N, and/or by varying the thickness and/or rigidity of the inner annular wall 20 along its longitudinal axial length and thereby varying the implosion resistance of the inner annular wall 20 from a location adjacent one annular array to a location adjacent another annular array. If desired, the energy provided to individual objects 28 in a particular ring can be varied from object to object in that ring by suitable variation in the composition and/or quantity of explosive material, by suitable variation in the mass of the objects in that ring, and/or by suitable variation in the underlying structure.

Figure 3:
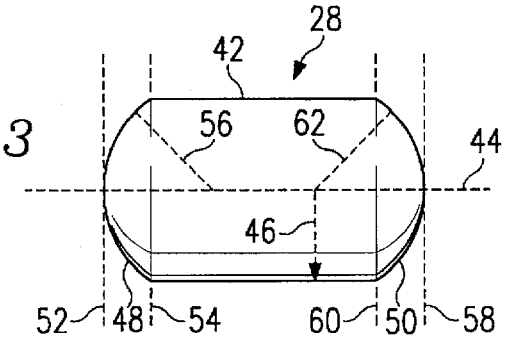
FIG. 3 is an illustration of a presently preferred configuration for the lethality enhancing objects.

Each of the lethality enhancing objects 28 should have an external configuration which minimizes aerodynamically induced deviations in the path of the object during the deployment of the object. Referring now to FIG. 3, the presently preferred configuration for a lethality enhancing object 28 is a cycloid, and more specifically, a shape of a right circular cylinder 42 having a longitudinal axis 44 and a radius 46, in combination with a first convex spherical segment 48 instead of a planar surface at the first end of the right circular cylinder 42 and a second convex spherical segment 50 instead of a planar surface at the second end of the right circular cylinder 42. The spherical segment 48 of a first sphere having its center on the longitudinal axis 44 is defined by two parallel planes 52, 54 with the plane 52 being tangent to the first sphere and the distance between the two planes 52, 54 being less than or equal to the radius 56 of the first sphere with the radius 56 of the first sphere being greater than or equal to the radial dimension 46 of the right circular cylinder 42. Similarly, the spherical segment 50 of a second sphere having its center on the longitudinal axis 44 is defined by two parallel planes 58, 60 with the plane 58 being tangent to the second sphere and the distance between the two planes 58, 60 being less than or equal to the radius 62 of the second sphere with the radius 62 of the second sphere being greater than or equal to the radial dimension 46 of the right circular cylinder 42. Referring again to FIG. 2, the lethality enhancing objects 28 are preferably positioned with their longitudinal axes at least generally parallel to the longitudinal axis 15 of the lethality enhancing device 13. In general each ratio of spherical radius to the cylindrical radius will be in the range of about 1:1 to about 10:1. However, it is presently preferred for the radius 56 of the first sphere to be equal to the radius 62 of the second sphere, and for the ratio of the spherical radius to the cylindrical radius to be in the range of about 1.1:1 to about 5:1 in order to simplify the formation of the lethality enhancing object 28 by sintering metal particles in a mold having the desired shape, such that no machining of the molded object is required. This presently preferred configuration for the lethality enhancing objects 28 permits the lethality enhancing objects 28 to be closely packed in the matrix 26 and to provide a greater total mass of the lethality enhancing objects in a given volume of objects 28 and matrix 26 than would be possible with a spherical configuration.

Each lethality enhancing object 28 is preferably fabricated from a dense metal. While any suitable dense metal can be employed, metals having a density of at least 15 gm/cc are presently preferred, e.g., tantalum, tungsten, rhenium, uranium, etc. The higher densities permit a greater mass in a given volume or the same mass in a smaller volume, thereby enhancing the impact force of a lethality enhancing object 28 while decreasing the surface area exposed to aerodynamic forces. A presently preferred lethality enhancing object 28 is formed of pressed sintered particles of ductile tungsten. In general, each lethality enhancing object 28 will have a mass greater than about 50 grams, preferably greater than about 100 grams, and more preferably at least about 150 grams. In contrast, fragments from a blast fragmentation can be on the order of 1 to 10 grams.

The inner wall member 20 has an annular flange section 64 extending longitudinally forwardly from the radial flange 32, and an annular booster ring 66 is positioned coaxially with and radially outwardly of the annular flange section 64 so as to be in contact with the external surface of the annular flange section 64 and the forward facing surface of the radial flange 32. The radial flange 32 is provided with a plurality of holes 68 which extend therethrough at least substantially parallel to the longitudinal axis 15 and which are spaced apart from each other in a circular configuration so that the forward end of the annular body 22 of low velocity explosive is exposed to each of the holes 68. Any suitable number of holes 68 can be employed, preferably positioned at equally spaced intervals in the circular configuration. Each hole 68 contains an initiator pellet 70 surrounded by an annular plastic support 72. The annular booster ring 66 is mounted on the front side of radial flange 32 so as to overlie each of the holes 68 and to cause the initiator pellets 70 to contact both the booster ring 66 and the annular body 22 of low velocity explosive. Thus, the booster ring 66 is positioned in proximity to the forwardmost first annular explosive section **22*a*, so as to initially fire the forwardmost first annular explosive section 22*a***.

The booster ring 66 can be a plastic ring containing an explosive lead charge network. A suitable detonator, e.g., an exploding foil detonator device, can be mounted against the booster ring 66 so that upon the application of an electrical firing signal to the detonator, the detonator fires the explosive lead charge network in the booster ring 66, which ignites each of the initiator pellets 70 to thereby detonate the low velocity explosive material in annular body 22. The electrical firing signal can be provided in response to a sensor detecting the attainment of a desired distance to the target or in response to a signal representing the expiration of a predetermined time-of-flight.

An annular fitting member 76 has a generally L-shaped section 78 having one leg thereof extending radially inwardly toward the longitudinal flange 64 and the other leg thereof extending rearwardly toward the matrix 26, so that the L-shaped section 78, the longitudinal flange section 64, and the radial flange 32 form an annular compartment 80 and collectively substantially enclose the booster ring 66 within the annular compartment 80. If desired, the radial flange 32 can extend outwardly to the external shell 80 in order to increase the protection for the booster ring 66. The fitting member 76 has an annular flange 82 which extends from an intermediate section of the fitting member 76 radially inwardly beyond the inner surface of the flange section 64 of the inner wall member 20. The fitting member 76 also has an annular section 84, which extends outwardly and forwardly from the intermediate portion, and an annular flange 86, which extends longitudinally forwardly from the outer end of the annular section 84. The external diameter of the flange 86 is slightly less than the internal diameter of the annular external shell 30 and the internal diameter of the shell flange 88 of the guidance section 12, such that flange 86 provides a mounting shoulder for receiving the rearwardly extending annular flange 88 of the guidance section 12, whereby the guidance section 12 and the lethality enhancing device 13 can be joined together by suitable means, e.g., radially extending screws (not shown) extending through the annular flange 88 or the shell 30 into the axially extending flange 86.

Positioned within the central cavity formed within the annular fitting member 76 are first and second safe arm fuzes 90, 92 for the booster ring 66. The safe arm fuzes 90, 92 can be encased by a shock attenuating foam material 94. The wiring 96 extends from the safe arm fuzes 90, 92 through an opening in the annular section 84 and an opening in the L-shaped section 78 to the booster ring 66. As the radial flange 82 provides a central opening therein and the inner wall 20 is hollow throughout its length, the wiring to the safe arm fuzes as well as for other components of the missile can pass through the hollow center of the warhead section 13.

While it is possible for the exterior surface of the matrix layer 26 containing the arrays 40*a*–40N of lethality enhancing objects 28 to constitute the outer cylindrical surface of the lethality enhancing device 13, the shell 30 can circumferentially surround the matrix layer 26 and serve as an ablator layer to provide additional thermal protection during the flight of the missile 11. When employed, the shell 30 does not have to constitute a significant component of the missile 11 from the standpoint of structural strength, and the shell 30 is readily penetrated by the lethality enhancing objects 28 upon deployment thereof without adversely affecting the paths of the lethality enhancing objects 28. The inner wall member 20 can provide most of the structural strength of the lethality enhancing device 13 and opposes inwardly directed forces during detonation of the annular body 22. In an alternative embodiment, the shell 30 can be an external load-bearing wall formed of any suitable load bearing material, e.g., aluminum, titanium, graphite epoxy composite, etc., such that the inner wall 20 does not have to be a load bearing structure.

Figure 4:
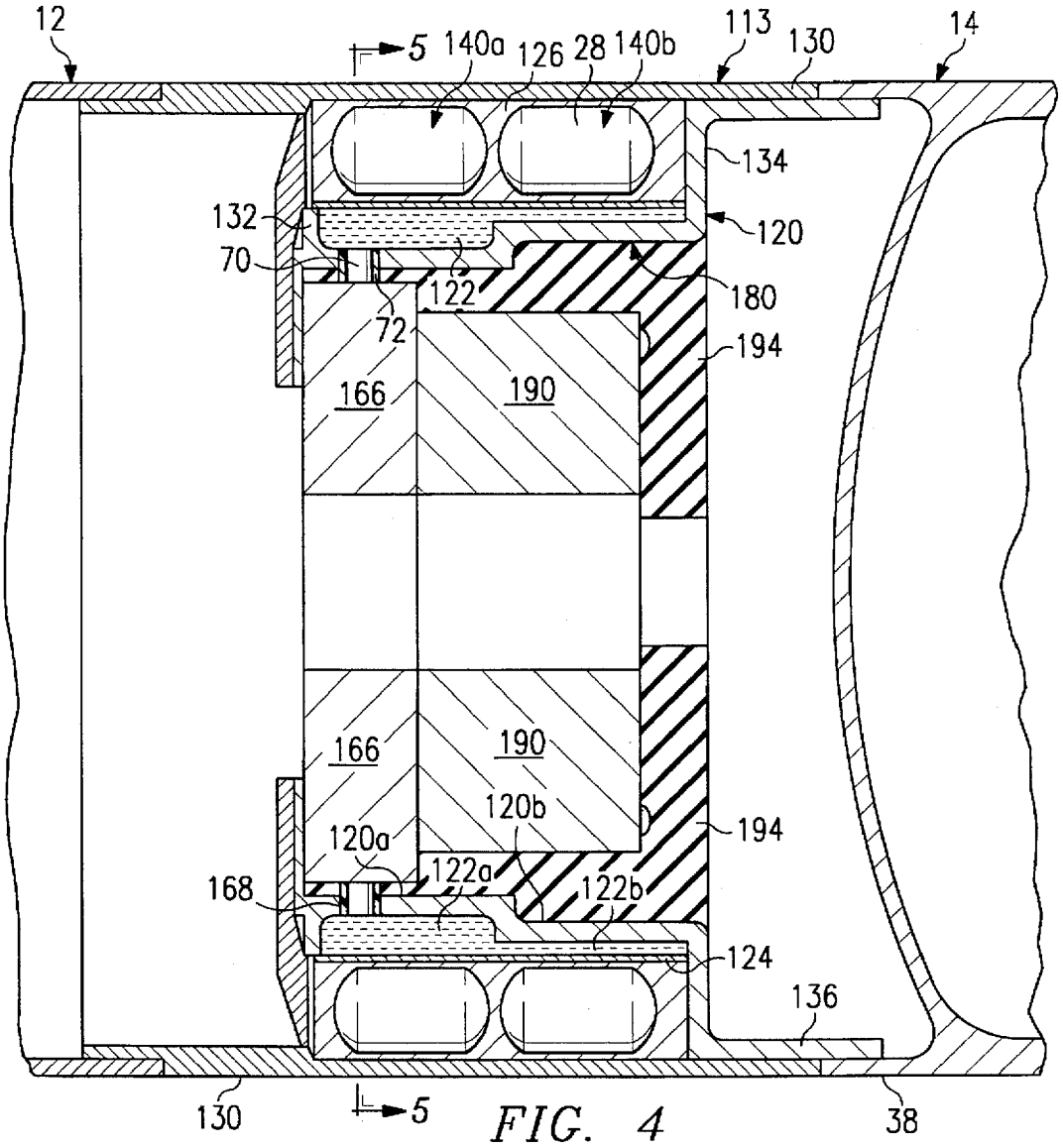
FIG. 4 is a cross-sectional view along a portion of the longitudinal axis of the missile of FIG. 1 illustrating a second embodiment of the present invention.
Figure 5:
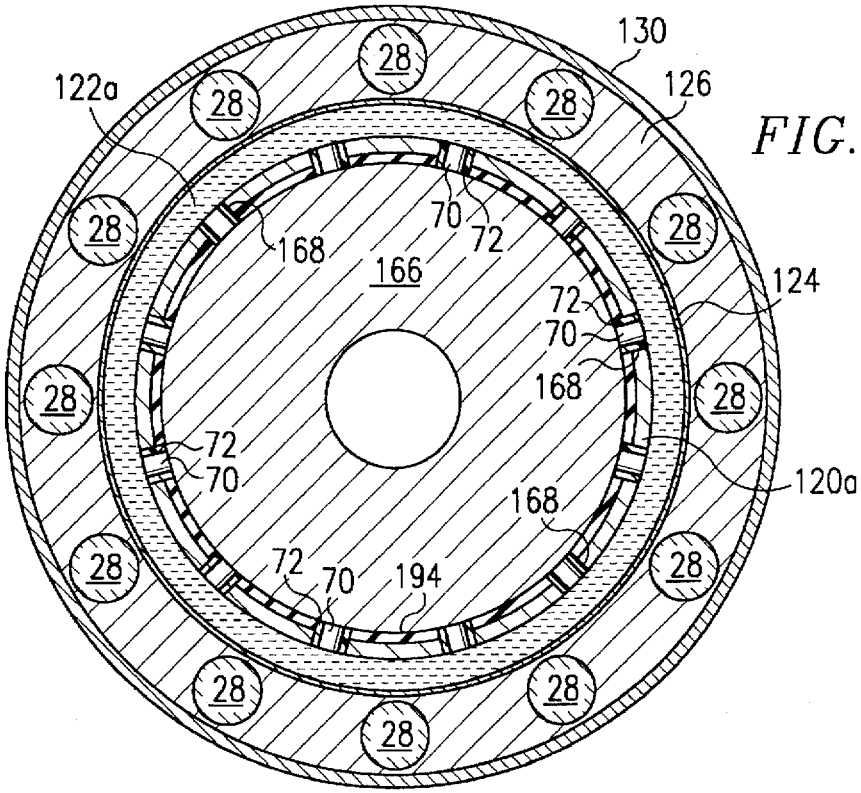
FIG. 5 is a cross-sectional view taken along line 5—5 in FIG. 4 for a first version of the second embodiment.

A second embodiment of the invention is illustrated in FIGS. 4 and 5. Components which are the same as in the first embodiment are given the same reference characters, and a detailed description thereof is not repeated. Components which are somewhat similar to components in the first embodiment are identified by the corresponding reference character being raised by 100.

The lethality enhancing device 113 has an inner annular wall member 120, an annular body 122 of a low velocity explosive, an annular liner wall 124, an annular matrix 126 containing a plurality of arrays of discrete objects 28, and an annular external shell 130. Each of the inner annular wall member 120, the annular body 122, the annular liner wall 124, the annular matrix 126, and the annular external shell 130 has a central longitudinal axis which extends along the central longitudinal axis 15 of the missile 11.

The inner annular wall member 120 comprises two annular wall sections 120*a* and 120*b* which are spaced along the central longitudinal axis 15, with each of the annular wall sections 120*a* and 120*b* having a substantially cylindrical outer surface, and having differing outer diameters, thus forming a stepped exterior surface for the annular wall member 120. In the illustrated embodiment, the outer diameter of the first annular wall section 120*a* is smaller than the outer diameter of the adjacent second annular wall section 120*b*.

The inner annular wall 120 has an annular flange 132 which extends radially outwardly from the front edge of the forwardmost annular wall section 120*a*, and an annular flange 134 which extends radially outwardly from the rear edge of the rearmost annular wall section 20*b*. The annular flanges 132 and 134 provide reflective surfaces for explosive pressure waves in the annular body 122 of low velocity explosive. The inner wall 120 also includes an annular flange 136 which extends longitudinally rearwardly from the outer edge of flange 134.

The annular liner wall 124, which is of cylindrical configuration, is positioned exteriorly of and spaced from the inner wall member 120. The annular body 122 of a low velocity explosive is positioned exteriorly of the inner wall member 120 and interiorly of the annular liner wall 124. The annular body 122 of low velocity explosive has a stepped internal configuration so as to mate with the stepped external configuration of the inner wall member 120, and a generally cylindrical external configuration so as to mate with the cylindrical inner configuration of annular liner wall 124. Accordingly, the annular body 122 fills the annular space defined by the exterior surface of the stepped portions 120*a* and 120*b* of the annular inner wall 120, the inner surface of the annular liner wall 124, the rearwardly facing surface of the annular flange 132 and a portion of the forward surface of the flange 134. Thus, in the illustrated embodiment, the annular body 122 of low velocity explosive comprises two annular explosive sections 122*a* and 122*b*, with each of the annular explosive sections being positioned coaxially with and radially exteriorly of the substantially cylindrical outer surface of a respective one of the annular wall sections 120*a* and 120*b*. Thus, the radial thickness of the annular explosive section 122*a* is greater than the radial thickness of the annular explosive section 122*b*.

The lethality enhancing objects 28 are embedded in the annular matrix 126, such that the annular matrix 126 and the discrete objects 28 fill the space between the outer surface of the annular liner wall 124 and the radially adjacent inner surface of the annular external shell 130. The discrete objects 28 are arranged in two arrays 140*a* and 140*b*, which are positioned coaxially with and exteriorly of the annular body 122 of explosive at different locations along the central longitudinal axis of the missile 11, with each annular array having a circular configuration in a plane perpendicular to the longitudinal axis 15 of the missile and containing a plurality of lethality enhancing objects 28 spaced apart about the circumferential extent of the respective array. The matrix 126 can have the same characteristics as the matrix 26. Similarly, the annular arrays 140*a* and 140*b* can have the same characteristics as the arrays 40*a*–40N.

In the illustrated embodiment, the array 140*a* contains twelve lethality enhancing objects 28 spaced at equal centerline-to-centerline intervals of approximately 30°, while the array 140*b* also contains twelve lethality enhancing objects 28 spaced at equal centerline-to-centerline intervals of approximately 30°, with the lethality enhancing objects 28 in the array 140*a* being offset from the lethality enhancing objects 28 in the array 140*b* by approximately 15°.

In the embodiment illustrated in FIGS. 4 and 5, the annular explosive sections 122*a* and 122*b* have substantially different radial thicknesses. Assuming a uniform concentration of the low velocity explosive in the annular body 122 of explosive, then the amount of the low velocity explosive in the annular explosive section 122*a* in radial alignment with the first annular array 140*a* is substantially greater than the amount of the low velocity explosive in the second annular explosive section 122*b* in radial alignment with the second annular array 140*b*. Thus, each of the annular explosive sections 122*a* and 122*b* can have an amount of low velocity explosive which is different from the amount of the low velocity explosive in the other annular explosive section. With each of the arrays 140*a* and 140*b* containing the same number of objects 28, the amount of energy provided to each of the plurality of objects 28 in the first annular array 140*a* by the amount of the low velocity explosive in the first annular explosive section 122*a* would be greater than the amount of energy provided to each of the plurality of objects 28 in the second annular array 140*b* by the amount of the low velocity explosive in the second annular explosive section 122*b*. However, the variation in energy provided the lethality enhancing objects 28 individually can also be achieved by varying the mass of the lethality enhancing objects 28, varying the composition of the low velocity explosive body 122 adjacent the annular arrays 140*a* and 140*b*, and/or by varying the thickness and/or rigidity of the inner wall 120 along its longitudinal axial length and thereby varying the implosion resistance of inner wall 120 from a location adjacent the first annular array 140*a* to a location adjacent the second annular array 140*b*.

An annular booster ring 166 is positioned coaxially with and radially inwardly of the first annular wall section 120*a*, so as to be substantially enclosed within the central chamber 180 formed by the inner wall 120. This configuration permits a reduction in the longitudinal length of the warhead section 13 as compared with the configuration of the embodiment of FIG. 2 wherein the booster is spaced longitudinally away from the explosive body 22. The annular wall section 120*a* is provided with a plurality of holes 168 which extend at least substantially radially therethrough and which are spaced apart from each other in a circular configuration so that the first annular explosive section 122*a* is exposed to each of the holes 168. Any suitable number of holes 168 can be employed, preferably positioned at equally spaced intervals in the circular configuration. Each hole 168 contains an initiator pellet 70 surrounded by an annular plastic support 72. The annular booster ring 166 overlies each of the holes 168 so as to cause the initiator pellets 70 to contact both the booster ring 166 and the annular body 122 of low velocity explosive. Thus, the booster ring 166 is positioned in proximity to the forwardmost first annular explosive section 122*a* so as to initially fire the forwardmost first annular explosive section 122*a*. The booster ring 166 can be similar to the booster ring 66 except for its position. A safe arm fuze 190, which can be a single safe arm fuze or a combination of two or more safe arm fuzes, can be positioned coaxially with and radially inwardly of the second annular wall section 120*b*, so as to be substantially enclosed within the central chamber 180 formed by the inner wall 120. If desired, the safe arm fuze 190 can be encased in a shock attenuating foam material 194.

In the embodiment of FIG. 5, the number of holes 168 equals the number of objects 28 in the first array 140*a*. The holes 168 are spaced at approximately 30° intervals about the circumference of the first annular wall section 120*a*, and are offset with respect to the objects 28 in the first array 140*a* such that each hole 168 is in radial alignment with a point approximately midway between a respective pair of objects 28 in the first array 140*a*. This arrangement provides for equal energy levels to be imparted to the objects in the forwardmost array. However, other configurations can be employed. Thus, the embodiment of FIG. 6 has twelve holes 168, each of which is in radial alignment with a respective one of the twelve objects 28 in the first array 140*a*. This arrangement also provides for equal energy levels to be imparted to the objects in the forwardmost array. The embodiment of FIG. 7 has eight holes 168 spaced apart at 45° intervals, with four of the holes 168 being in axial alignment with a respective one of the twelve objects 28 in the first array 140*a* while the other four holes are in radial alignment with a point approximately midway between a respective pair of the objects 28 which are not in radial alignment with a hole 168. This arrangement provides for a higher energy level to be imparted to each of the radially aligned objects 28 in the forwardmost array in comparison to the energy level imparted to the objects 28 which are not radially aligned with a hole 168.

Figure 6:
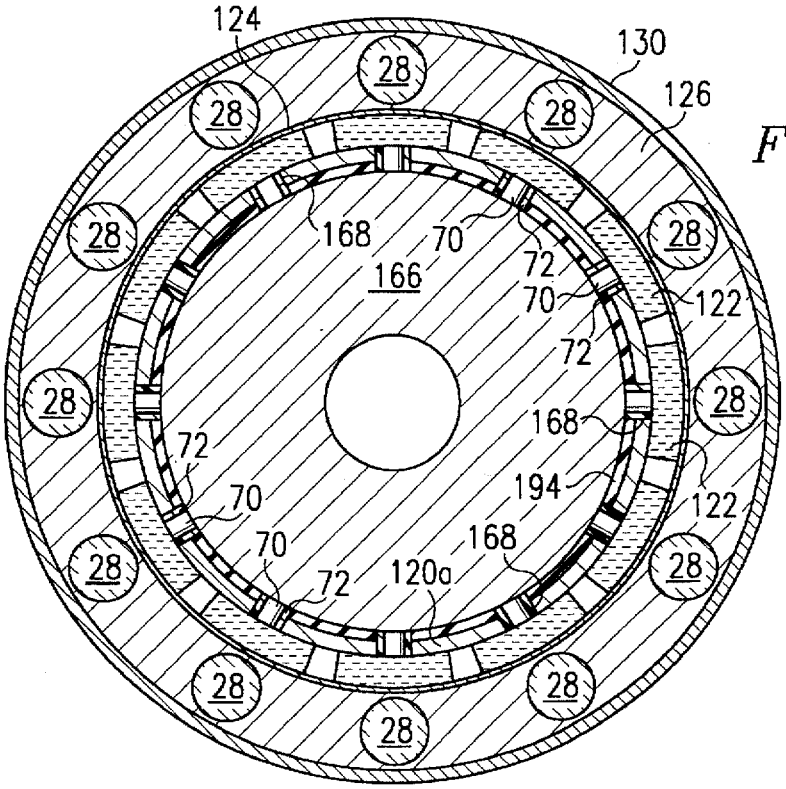
FIG. 6 is a cross-sectional view taken along line 5—5 in FIG. 4 for a second version of the second embodiment.
Figure 7:
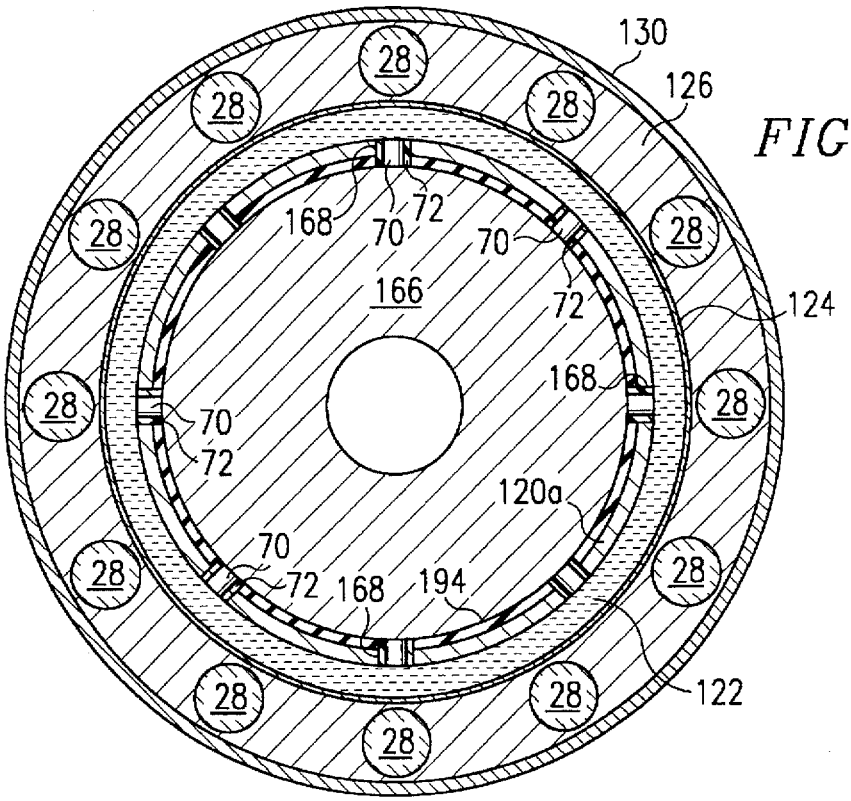
FIG. 7 is a cross-sectional view taken along line 5—5 in FIG. 4 for a third version of the second embodiment.

While each of the annular explosive sections 122*a* and 122*b* can be a continuous uninterrupted ring of explosive material, it is possible for one or both of the annular explosive sections 122*a* and 122*b* to comprise a plurality of individual annular segments spaced apart from each other about the circumference of the annular explosive section, as illustrated in FIG. 6. This configuration permits a savings in the amount of low explosive material when the objects in the radially adjacent array are spaced apart a significant distance. When the first annular explosive section 122*a* is a continuous uninterrupted ring of explosive material, the second annular explosive section 122*b* can comprise the spaced discrete segments, in order to provide a reduced amount of explosive material for each object 28 in the second array 122*b* as compared to the objects 28 in the first array 122*a*, even though the first and second annular explosive sections 122*a* and 122*b* have the same radial thickness.

Figure 8:
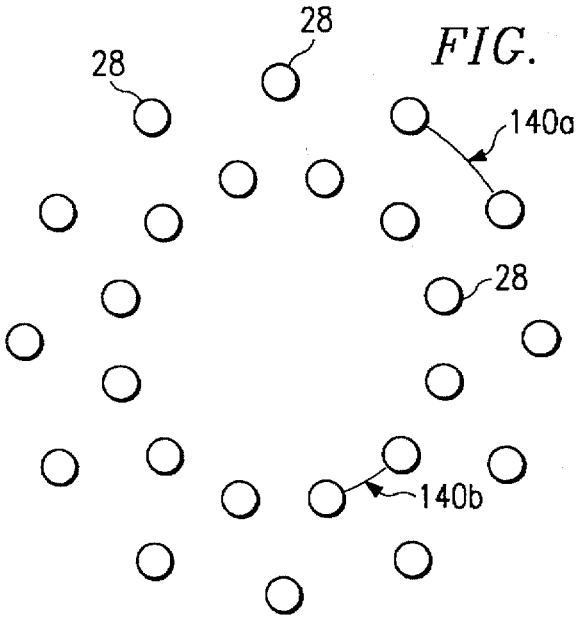
FIG. 8 is an illustration of the pattern of objects which can be obtained with the second embodiment.

FIG. 8 is a representation of the radial deployment of the lethality enhancing objects 28, in a plane perpendicular to the line of flight of the missile 11, by the warhead embodiment of FIGS. 4 and 5, wherein the twelve objects 28 of the first array 140*a* have been dispersed at a higher velocity than the twelve objects 28 of the second array 140*b* so that the objects 28 in the deployed first array 140*a* form a circle having a greater radius than the circle formed by the objects 28 in the deployed second array 140*b*.

The annular body 22 or 122 of low velocity explosive should have a low velocity of detonation so that the radial deployment of the lethality enhancing objects 28 occurs at a relatively low velocity without deformation of the lethality enhancing objects 28 from the low velocity explosive forces. Any suitable low velocity explosive can be employed to form the annular body 22 or 122. While a detonation velocity less than about 6000 meters per second is generally considered to be a low detonation velocity value, the detonation velocity of the annular body 22 or 122 will generally be less than 5500 meters per second and will preferably be less than 5000 meters per second, and will more preferably be less than 4000 meters per second. The resulting radial deployment velocity of the objects 28 will generally be less than about 1000 feet per second, preferably less than about 600 feet per second, and more preferably less than about 500 feet per second. In contrast, granular, cast, or crystal TNT has a detonation velocity substantially in excess of 6000 meters per second, the speed of the interceptor missile 11 towards its target can exceed 5000 feet per second, and the speed of fragments resulting from a blast-fragmentation will normally be greater than 3000 feet per second.

The special welding powder #6B, available from Trojan Corporation, Spanish Fork, Utah, has been employed in a loose powder form as a low velocity explosive for this type of warhead. Similarly, a low velocity explosive material comprising a polymeric matrix, to facilitate handling of the annular body 22 and to avoid any shifting of a powder explosive, has been employed. Thus an explosive composition of pentaerythrol tetranitrate (PETN) in an elastomer, such as silicon rubber, has been found to be useful. The amount of PETN in such composition will generally be in the range of about 10 to about 30 weight percent, preferably in the range of about 20 to about 25 weight percent, with the amount of the elastomer being in the range of about 90 to about 70 weight percent, preferably in the range of about 80 to about 75 weight percent.

However, in accordance with an aspect of the present invention, it is desirable that the low velocity explosive contain a foaming agent in order to achieve the desired combination of detonation pressure, energy, and explosive thickness. In general the annular body 22 or 122 will have a density of less than about 1.2 g/cc, and preferably less than about 1.1 g/cc. The low density of the annular body 22 or 122 reduces stress on the objects 28, and permits volume variations due to dimensional tolerances of the mold without causing significant changes in explosive energy. The presently preferred low explosive composition is formed by mixing a liquid explosive, a powder explosive, and a liquid polymerizable material containing a foaming agent, such that the liquid explosive acts to reduce the viscosity of the resulting mixture. A liquid polymerization catalyst is added to the mixture just prior to the injection of the mixture into a mold to produce a rigid foam. An exemplary composition comprises trimethylolethane trinitrate (TMETN), PETN, liquid ($CO_2$-blown) polyurethane foam, and an isocyanate catalyst.

In general, the amount of low velocity explosive incorporated in the composition is a function of the thickness of the ring of low velocity explosive required for the lowest object deployment velocity. The minimum low velocity explosive thickness that will detonate is inversely proportional to the weight percentage of the low velocity explosive in the composite material.

The use of low deployment velocities for the lethality enhancing objects 28 reduces the amount of low velocity explosive material needed to produce the desired pattern, as well as eliminates a need for a very sensitive firing system which would be required for use with high velocity fragments.

Reasonable variation and modifications are possible within the scope of the foregoing description, the drawings and the appended claims to the invention. For example, any suitable number of arrays of lethality enhancing objects can be employed. The mass of the lethality enhancing objects can vary within an array and from array to array. In order to adjust the direction of deployment of a lethality enhancing object, the lethality enhancing object can be positioned with its longitudinal axis at an angle to the longitudinal axis of the missile, the explosive body can be positioned at an angle to the longitudinal axis of the missile, and/or the location of the initial detonation points can be varied.

That which is claimed is:

1. In a device for radially deploying a plurality of objects at a low velocity in order to achieve a predetermined pattern of the deployed objects, said device comprising:

an inner wall member having a central longitudinal axis, an annular body of low velocity explosive having a central longitudinal axis and a density of less than about 1.2 g/cc, said annular body of low velocity explosive having a detonation velocity of less than 6000 meters per second, said annular body of low velocity explosive being positioned exteriorly of said inner wall member with the central longitudinal axis of said annular body of low velocity explosive extending at least substantially along the central longitudinal axis of said inner wall member, a plurality of annular arrays positioned coaxially with and exteriorly of said annular body of low velocity explosive at different locations along the central longitudinal axis of said annular body of low velocity explosive, each of said annular arrays comprising a plurality of objects positioned at spaced locations about the circumference of the respective annular array; the improvement:

wherein said inner wall member comprises a plurality of annular wall sections spaced along said central longitudinal axis, each of said annular wall sections having a substantially cylindrical outer surface, with longitudinally adjacent annular wall sections having differing outer diameters;

wherein said annular body of low velocity explosive comprises a plurality of annular explosive sections, each of said annular explosive sections being positioned coaxially with and exteriorly of the substantially cylindrical outer surface of a respective one of said annular wall sections;

wherein each of said annular arrays is positioned coaxially with and exteriorly of a respective one of said annular explosive sections and a respective one of said annular wall sections to form a radially adjacent combination of an annular wall section, an annular explosive section, and an annular array; and wherein each such radially adjacent combination differs from each radially adjacent combination longitudinally adjacent thereto by at least one of an amount of low velocity explosive in the respective annular explosive sections, a composition of the low velocity explosive in the respective annular explosive sections a radial thickness of the respective annular wall sections, a rigidity of the respective annular wall sections and the mass of the plurality of objects in the respective annular arrays, such that the energy provided to the objects in a first one of said plurality of annular arrays by the annular explosive section radially adjacent thereto is different from the energy provided to the objects in a second one of said plurality of annular arrays by the annular explosive section radially adjacent thereto.

2. A device in accordance with claim 1, wherein each of said annular explosive sections has a different radial thickness such that each of said annular explosive sections has an amount of said low velocity explosive which is different from the amounts of said low velocity explosive in the other annular explosive sections.

3. A device in accordance with claim 1, wherein said plurality of annular explosive sections includes a forwardmost first annular explosive section and a second annular explosive section which is longitudinally adjacent to said forwardmost first annular explosive section, and wherein said device further comprises a booster ring positioned in proximity to said forwardmost first annular explosive section so as to initially fire said forwardmost first annular explosive section.

4. A device in accordance with claim 3, wherein said plurality of annular arrays includes a forwardmost first annular array and a second annular array, wherein said forwardmost first annular array is positioned radially outwardly of said forwardmost first annular explosive section, wherein said second array is positioned radially outwardly of said second annular explosive section, and wherein the energy provided by said forwardmost first annular explosive section to each of the objects in said forwardmost first annular array is greater than the energy provided by said second annular explosive section to each of the objects in the second annular array.

5. A device in accordance with claim 3, wherein said plurality of annular arrays includes a forwardmost first annular array and a second annular array, wherein said forwardmost first annular array is positioned radially outwardly of said forwardmost first annular explosive section, wherein said second array is positioned radially outwardly of said second annular explosive section, wherein the energy provided by said forwardmost first annular explosive section to each of the objects in said forwardmost first annular array is less than the energy provided by said second annular explosive section to each of the objects in the second annular array.

6. A device in accordance with claim 3, wherein said forwardmost first annular explosive section contains an amount of said low velocity explosive which is greater than the amount of said low velocity explosive in the second annular explosive section.

7. A device in accordance with claim 3, wherein said second annular explosive section contains an amount of said low velocity explosive which is greater than the amount of said low velocity explosive in the forwardmost first annular explosive section.

8. A device in accordance with claim 7, wherein said plurality of annular arrays comprises at least three annular arrays.

9. A device in accordance with claim 8, wherein said plurality of annular explosive sections further comprises a third annular explosive section positioned longitudinally adjacent to said second annular section, and wherein said third annular explosive section contains an amount of said low velocity explosive which is less than the amount of said low velocity explosive in the forwardmost first annular explosive section.

10. A device in accordance with claim 3, wherein said forwardmost first annular explosive section is positioned radially outwardly of a forwardmost one of said plurality of annular wall sections, wherein said booster ring is positioned radially inwardly of said forwardmost one of said plurality of annular wall sections, and wherein said forwardmost one of said plurality of annular wall sections contains a plurality of holes extending at least generally radially therethrough to expose said forwardmost first annular explosive section to detonation of said booster ring.

11. A device in accordance with claim 10, wherein said plurality of annular arrays includes a forwardmost first annular array and a second annular array, wherein said forwardmost first annular array is positioned radially outwardly of said forwardmost first annular explosive section, wherein said second annular array is positioned radially outwardly of said second annular explosive section, wherein said plurality of holes in said forwardmost one of said plurality of annular wall sections comprises a first group of holes at spaced locations about the circumference of said forwardmost one of said plurality of annular wall sections, and wherein each of said first group of holes is positioned in radial alignment with a respective one of the objects of said forwardmost first annular array.

12. A device in accordance with claim 11, wherein said plurality of holes in said forwardmost one of said plurality of annular wall sections further comprises a second group of holes at spaced locations about the circumference of said forwardmost one of said plurality of annular wall sections, and wherein each of said second group of holes is positioned in radial alignment with an intermediate point between a respective pair of the objects of said forwardmost first annular array.

13. A device in accordance with claim 12, wherein each of said second group of holes is positioned in radial alignment with a midpoint point between a respective pair of the objects of said forwardmost first annular array, and wherein each said respective pair of objects in said forwardmost first annular array is positioned between two of the objects of said forwardmost first annular array which are in radial alignment with two of said first group of holes.

14. A device in accordance with claim 10, wherein said plurality of annular arrays includes a forwardmost first annular array and a second annular array, wherein said forwardmost first annular array is positioned radially outwardly of said forwardmost first annular explosive section, wherein said second array is positioned radially outwardly of said second annular explosive section, wherein said holes in said forwardmost one of said plurality of annular wall sections are at spaced locations about the circumference of said forwardmost one of said plurality of annular wall sections, and wherein each of said holes is positioned so as not to be in radial alignment with any of the objects of said forwardmost first annular array.

15. A device in accordance with claim 10, wherein said plurality of annular wall sections includes a second annular wall section positioned longitudinally adjacent to said forwardmost one of said annular wall sections, wherein said device further comprises a safe arm fuze for said booster ring, said safe arm fuze being positioned radially inwardly of said second annular wall section.

16. A device in accordance with claim 10, wherein said device further comprises first and second safe arm fuzes for said booster ring, said first and second safe arm fuzes being encased in shock attenuating foam.

17. A device in accordance with claim 10, wherein said plurality of arrays consists of two arrays, and wherein said forwardmost first annular explosive section contains an amount of said low velocity explosive which is greater than the amount of said low velocity explosive in the second annular explosive section.

18. A device in accordance with claim 3, wherein said inner wall member has an annular flange extending radially outwardly therefrom, said annular flange having a forwardly facing surface and a rearwardly facing surface, wherein said forwardmost first annular explosive section is positioned against said rearwardly facing surface and said booster ring is positioned against said forwardly facing surface, and wherein said annular flange has a plurality of holes therethrough to expose said forwardmost first annular explosive section to detonation of said booster ring.

19. A device in accordance with claim 18, wherein said inner wall member has a portion extending longitudinally forwardly of said annular flange, said booster ring being positioned radially outwardly of said portion, and wherein said device further comprising an annular fitting member positioned adjacent said portion of said inner wall member so that said annular fitting member and said inner wall member collectively substantially enclose said booster ring.

20. A device in accordance with claim 18, wherein a rearmost end portion of said inner wall member extends at least generally radially outwardly to provide a reflective surface for explosive pressure waves in said annular body of low velocity explosive.

21. A device in accordance with claim 1, wherein said inner wall member is formed of metal.

22. A device in accordance with claim 1, wherein at least one of said annular explosive sections comprises a plurality of segments of explosive material spaced apart from each other about the circumference of said annular body of low velocity explosive.

23. In a device for radially deploying a plurality of objects at a low velocity in order to achieve a predetermined pattern of the deployed objects, said device comprising:

an inner wall member having a central longitudinal axis, an annular body of low velocity explosive having a central longitudinal axis and a density of less than about 1.2 g/cc, said annular body of low velocity explosive having a detonation velocity of less than 6000 meters per second, said annular body of low velocity explosive being positioned exteriorly of said inner wall member with the central longitudinal axis of said annular body of low velocity explosive extending at least substantially along the central longitudinal axis of said inner wall member, a plurality of annular arrays positioned coaxially with and exteriorly of said annular body of low velocity explosive at different locations along the central longitudinal axis of said annular body of low velocity explosive, each of said annular arrays comprising a plurality of objects positioned at spaced locations about the circumference of the respective annular array; and a booster ring positioned in proximity to said annular body of low velocity explosive so as to fire said annular body of low velocity explosive; the improvement:

wherein said inner wall member is an annular wall member, wherein said booster ring is positioned radially inwardly of said annular wall member, and wherein said annular wall member contains a plurality of holes extending at least generally radially therethrough to expose said annular body of low velocity explosive to detonation of said booster ring.

24. A device in accordance with claim 23, wherein said plurality of holes are at spaced locations about the circumference of said annular wall member.

25. A device in accordance with claim 24, wherein a first array of said plurality of annular arrays is positioned generally radially outwardly of said plurality of holes, and wherein said plurality of holes comprises a first group of holes at spaced locations about the circumference of said annular wall member with each of said first group of holes being positioned in radial alignment with a respective one of the objects of said first array.

26. A device in accordance with claim 25, wherein said plurality of holes further comprises a second group of holes at spaced locations about the circumference of said annular wall member with each of said second group of holes being positioned in radial alignment with an intermediate point between a respective pair of the objects of said first array.

27. A device in accordance with claim 26, wherein each of said second group of holes is positioned in radial alignment with a midpoint point between a respective pair of the objects of said first array, and wherein each said respective pair of objects in said first array is positioned between two of the objects of said first array which are in radial alignment with two of said first group of holes.

28. A device in accordance with claim 23, wherein each of said plurality of holes is positioned so as not to be in radial alignment with any of the objects of said first array.

29. In a device for radially deploying a plurality of objects at a low velocity in order to achieve a predetermined pattern of the deployed objects, said device comprising:

an inner wall member having a central longitudinal axis, an annular body of low velocity explosive having a central longitudinal axis and a density of less than about 1.2 g/cc, said annular body of low velocity explosive having a detonation velocity of less than 6000 meters per second, said annular body of low velocity explosive being positioned exteriorly of said inner wall member with the central longitudinal axis of said annular body of low velocity explosive extending at least substantially along the central longitudinal axis of said inner wall member, a plurality of annular arrays positioned coaxially with and exteriorly of said annular body of low velocity explosive at different locations along the central longitudinal axis of said annular body of low velocity explosive, each of said annular arrays comprising a plurality of objects positioned at spaced locations about the circumference of the respective annular array; the improvement:

wherein said annular body of low velocity explosive comprises a plurality of annular explosive sections with at least one of said annular explosive sections comprising a plurality of segments of explosive material spaced apart from each other about the circumference of said annular body of low velocity explosive, and wherein each of said annular arrays is positioned coaxially with and exteriorly of a respective one of said annular explosive sections and a respective one of said annular wall sections to form a radially adjacent combination of an annular wall section, an annular explosive section and an annular array; and wherein each such radially adjacent combination differs from each radially adjacent combination longitudinally adjacent thereto by at least one of an amount of low velocity explosive in the respective annular explosive sections, a composition of the low velocity explosive in the respective annular explosive sections a radial thickness of the respective annular wall sections, a rigidity of the respective annular wall sections, and the mass of the plurality of objects in the respective annular arrays, such that the energy provided to the objects in a first one of said plurality of annular arrays by the annular explosive section radially adjacent thereto is different from the energy provided to the objects in a second one of said plurality of annular arrays by the annular explosive section radially adjacent thereto.

* * * * *